United States Patent [19]

McFarland

[11] 3,952,653

[45] Apr. 27, 1976

[54] STAMP DEVICE

[75] Inventor: Donald L. McFarland, Santa Barbara, Calif.

[73] Assignee: Fairfield Marking Products, Inc., Greenwich, Conn.

[22] Filed: Mar. 24, 1975

[21] Appl. No.: 561,319

[52] U.S. Cl. ..... 101/327; 101/368

[51] Int. Cl.[2] ..... B41K 1/02; B41K 1/38

[58] Field of Search ..... 101/41, 35, 327, 368, 101/369, 372, 379, 405

[56] References Cited

UNITED STATES PATENTS

| | | | |
|---|---|---|---|
| 1,965,814 | 7/1934 | Cantfort | 101/405 |
| 2,598,806 | 6/1952 | Lauer | 101/327 X |
| 2,966,116 | 12/1960 | Harris et al. | 101/368 |
| 3,342,911 | 9/1967 | Funahasi | 101/327 X |
| 3,389,654 | 6/1968 | Hirt | 101/35 |
| 3,402,663 | 9/1968 | Funahashi | 101/327 |
| 3,442,209 | 5/1969 | Funahashi | 101/327 |
| 3,468,252 | 9/1969 | Lemelson | 101/379 |
| 3,478,682 | 11/1969 | Funahashi | 101/327 |
| 3,631,799 | 1/1972 | Funahashi | 101/327 |
| 3,855,925 | 12/1974 | Funahashi | 101/405 X |

*Primary Examiner*—Clyde I. Coughenour
*Assistant Examiner*—Paul J. Hirsch

[57] ABSTRACT

A stamp device is constructed which comprises a housing having a gripping portion one end of which is closed and the other end of which is integral with a shoulder which is integral with a bellows which terminates in an open end, a rigid member having a projection extending from one surface disposed within said housing, an end member having a retaining lip on one surface and protuberances extending from the opposite surface, a self-inked stamp disposed within said end member, a depressible member disposed within said end member on top of the self-inked stamp and wherein said end member containing said self-inked stamp and said depressible member is inserted through the open end of said bellows and is held therein in a removable manner.

3 Claims, 3 Drawing Figures

STAMP DEVICE

The present invention is concerned with a stamping device which is simple and economical to manufacture, may be stood in a position suitable for use without accidentally stamping the word or words contained on the stamp, which is capable of rapid and continued use, and which produces an even impression upon stamping.

More particularly, the present invention comprises a housing having a gripping portion one end of which is closed and the other end of which is integral with a shoulder which is integral with a bellows which terminates in an open end. A rigid member having a projection extending from one surface thereof is inserted within the housing. The rigid member is of the same general configuration as the gripping portion of the housing. An end member having a retaining lip around one surface and protuberances around the opposite surface is provided into which is inserted a self-inked stamp having the word or words to be imprinted on the surface which comes in contact with the retaining lip. A depressible member is disposed within said end member on top of said self-inked stamp and the end member containing the self-inked stamp and the depressible member is inserted through the open end of said bellows so that a snap-fit arrangement results with the protuberances fitting into corresponding recesses in that portion of the housing between the shoulder and the bellows.

Various stamping devices are known in the art such as those disclosed in U.S. Pat. Nos. 878,420, 2,891,472, 3,020,838, 3,055,296, 3,090,304, 3,216,352, 3,241,482, 3,277,819, 3,342,911, 3,402,663, 3,442,209, 3,478,682, 3,491,683, 3,572,243, and 3,631,799. However, none of these references combines the features and advantages of the present invention whereby a stamping device is constructed of a minimal number of parts, thereby providing a simple and economically producible stamp of durable construction and which produces an even impression of word or words to be stamped upon use. The stamp device can be produced in any desired geometrical configuration such as square, circular or rectangular (as illustrated in the drawings).

FIGS. 1 to 3 more particularly illustrate the present invention:

Figure 1:
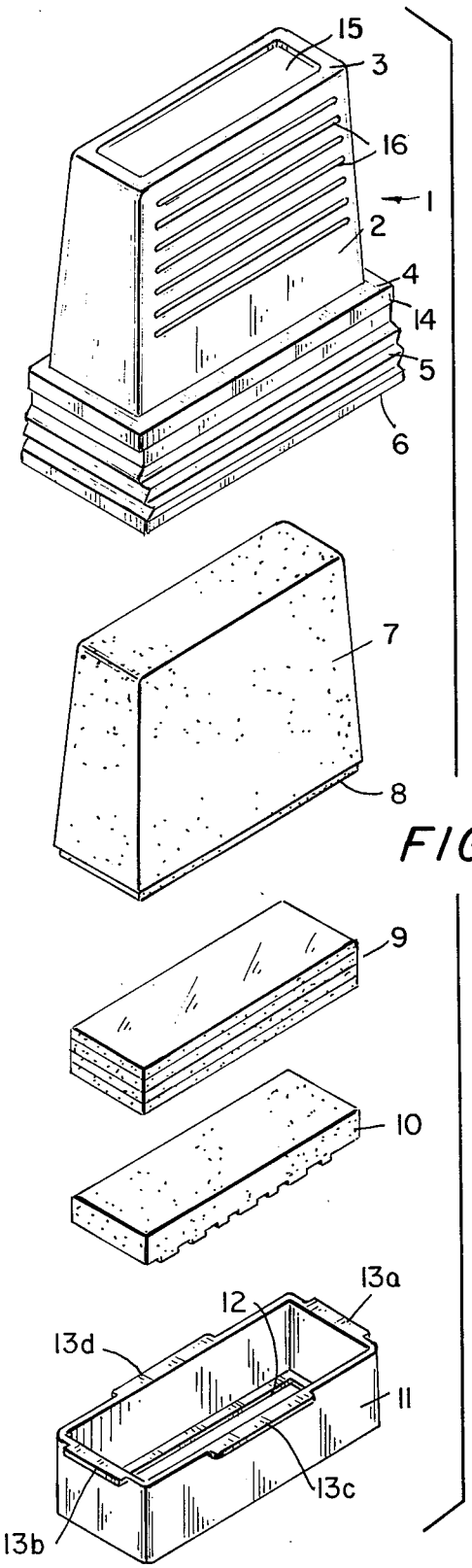
FIG. 1 is an exploded view in perspective.
Figure 2:
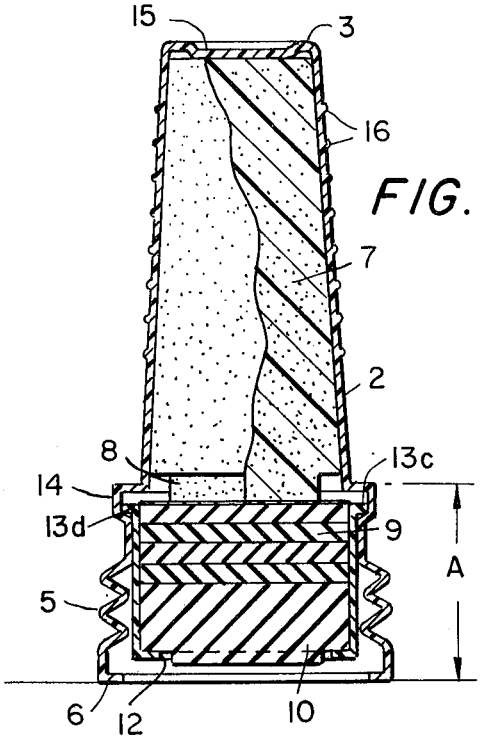
FIG. 2 is a transverse cross-section showing the stamping device in the non-operating position.
Figure 3:
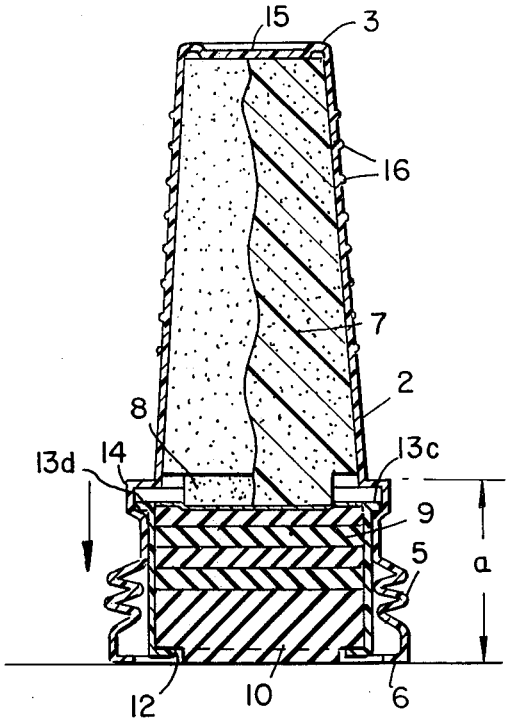
FIG. 3 is a transverse cross-section showing the stamping device in operation.

With reference to the drawings which illustrate a stamping device according to the present invention in a rectangular form, the device comprises a housing 1 which comprises a gripping portion 2 which has a closed end 3 and is integral with a shoulder 4 which, in turn, is integral with bellows 5 which terminates in open end 6. Rigid member 7 is of the same general configuration as gripping member 2 and has a projecting portion 8 extending from one surface thereof. Rigid member 7 is inserted through the open end of housing 1 and fits within gripping member 2 as shown in FIGS. 2 and 3. End member 11 is of a generally rectangular configuration and has retaining lip 12 running along one surface thereof and protuberances 13*a*, 13*b*, 13*c*, and 13*d* projecting from the opposite surface. Self-inked stamp 10 which has the word or words to be imprinted on the bottom surface is inserted into end member 11 so that the word or words are adjacent to the retaining lip 12. Depressible member 9 is then inserted on top of self-inked stamp 10. The end member thus containing self-inked stamp 10 and depressible member 9 is then inserted through the open end of housing 1 so that the protuberances on said end member 13*a*, 13*b*, 13*c* and 13*d* fit into recess portion 14 to provide a snap-fit.

In its assembled form, a stamping device of the present invention appears as is shown in FIG. 2 and may be stood on a surface without the word or words appearing on the bottom surface portion of self-inked stamp 10 contacting the surface on which the stamping device is resting.

The stamping device, if desired, may have a recess portion 15 which may receive a tag or other indicia showing the word or words which appear on the bottom portion of self-inked stamp 10. Additionally, for ease of operation and gripping, ridges 16 may be placed on two surfaces of gripping member 2 as shown in FIGS. 2 and 3.

In operation, one grips the stamping device by grasping gripping member 2 in a comfortable fashion and pressing downward as shown in FIG. 3 to compress the bellows so that the word or words on the bottom portion of self-inked stamp 10 come in contact with the appropriate surface on which the stamped impression is desired to be left. The bellows feature eliminates uneven resistance around the perimeter and produces a consistently even impression. Upon release, the bellows returns to the configuration shown in FIG. 2.

The present invention is thus particularly advantageous because of its simple construction with a minimal number of parts, the simplicity of the design, and the ability to produce a stamping device which produces an even impression in an inexpensive and economical manner wherein the self-inked stamp is re-inkable or replaceable as the ink is used up. If desired, the entire stamping device can be discarded when the self-inked stamp is dry and replaced with another device of the same construction.

When it is desired to construct the stamping device in a square, circular or other configuration, the configuration of the elements making up the device are modified accordingly.

Other and further uses and modifications of the instant invention will be more fully appreciated by those skilled in the art.

What is claimed is:

1. A stamping device which comprises a housing having a portion suitable to be gripped by a person's hand one end of which is closed and the other end of which is integral with a shoulder portion which is integral with a bellows portion having a mating ridge where the bellows joins the shoulder portion and which terminates in an open end, a rigid member constructed of the same general configuration as the gripping portion of the housing and having a projection extending from one surface thereof, said rigid member being inserted into the housing, an end member having a retaining lip around one surface thereof and having protuberances positioned on a second surface, a self-inked stamp totally disposed within said end member so that the word or words to be stamped are in contact with that portion of the end member having the retaining lip, a depressible member disposed within said end member on top of said self-inked stamp, said end member containing said self-inked stamp and said depressible member being fitted into the bellows portion of said housing so that the protuberances on the end member contact the mating ridge between said bellows and said shoulder to retain said end member within said housing in a removable manner.

2. A stamp device according to claim 1 wherein the closed end of the gripping portion has a slightly recessed portion suitable for carrying a label to identify the word or words contained on the self-inked stamp.

3. A stamp device according to claim 2 wherein the gripping portion of the housing has ridges along two surfaces to facilitate a person holding the gripping portion in one's hand.

* * * * *